United States Patent [19]

Anderson

[11] 4,019,339

[45] Apr. 26, 1977

[54] SYSTEM AND COLD CABINET SERVER

[76] Inventor: William G. Anderson, 5942 Gildred Circle, Huntington Beach, Calif. 92647

[22] Filed: Aug. 20, 1975

[21] Appl. No.: 606,094

[52] U.S. Cl. ..... 62/255; 62/257; 62/302; 62/449; 62/457

[51] Int. Cl.[2] ..... A47F 3/04

[58] Field of Search ..... 62/255, 256, 257, 298, 62/299, 302, 303, 448, 449, 457

[56] References Cited

UNITED STATES PATENTS

| | | | |
|---|---|---|---|
| 2,263,476 | 11/1941 | Sunday | 62/448 X |
| 2,719,410 | 10/1955 | Deering | 62/302 X |
| 3,056,274 | 10/1962 | Pouchert | 62/257 X |
| 3,210,957 | 10/1965 | Rutishauser et al. | 62/448 X |
| 3,561,230 | 2/1971 | Gatton et al. | 62/257 X |

*Primary Examiner*—Ronald C. Capossela

[57] ABSTRACT

A System and Cold Cabinet Server therefor to condition pre-packaged foods and to maintain them at serving temperature during storage and for customer access. A structural relationship of means is provided in cooperatively related bin type cabinets to combine the inherent principles of convection, absorption and recirculation to maximum advantage and to the end that heat induction from the surrounding atmosphere is minimized despite the completely open and accessible bin configuration. The Cold Cabinet is a self-sufficient entity provided with a replaceable refrigeration unit supplied with power such as an electrical plug-in, and is completely mobile; and adapted to be quickly assembled in service lines that are readily modified or broken down for storage.

5 Claims, 7 Drawing Figures

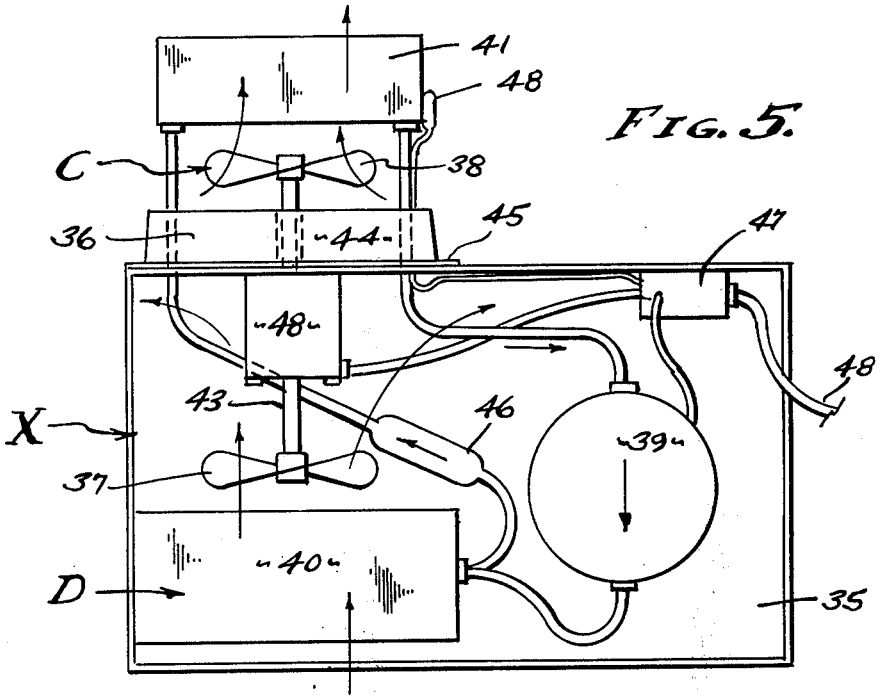
FIG. 5.
FIG. 6.
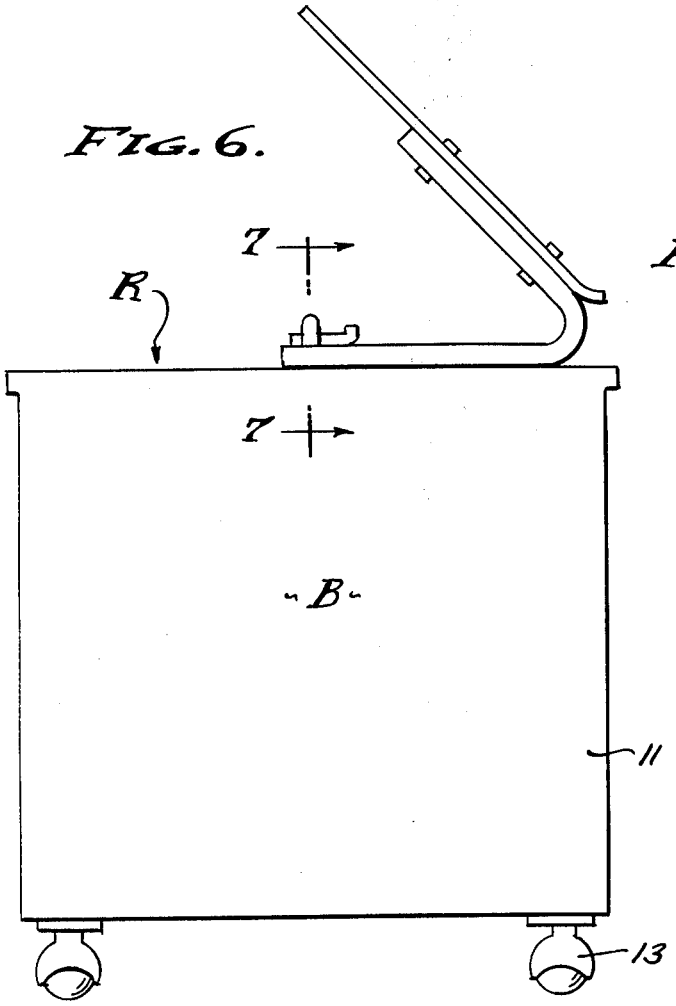
FIG. 7.
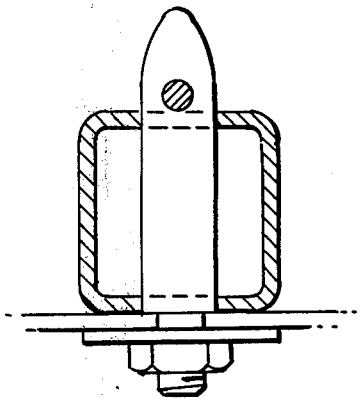

SYSTEM AND COLD CABINET SERVER

BACKGROUND

This invention relates to systemized food serving for institutional use in feeding large numbers of people during peak-feeding periods, for example in schools, industry, sports arenas, hospitals, etc. Mass feeding of properly prepared and conditioned foods is a problem where the numbers of persons to be served is large and the time period therefor small. Furthermore, the preparation of "a la carte" serving requires refrigerated, ambient, and oven temperatures to be applied and maintained, there being "pre-dished," "pre-portioned" and "pre-packaged" foods that are to be conditioned for serving by this system which includes therein the Cold Cabinet of the present invention. Generally, the system involves a cooperative arrangement of sequentially continuing cabinets, including a refrigerated cold cabinet R hereinafter described and claimed, a frozen cabinet F, a merchandizing cabinet M, and the Hot Cabinet H. These cooperative cabinets are of identical height and width configuration and are abutted in end to end relationship for self-serving from both sides. Pre-packaged foods, at hot, or cold or room temperature, transported from a central kitchen or the like are placed in the cabinets and brought to proper temperature for serving. For example, students serve themselves from lines at both sides of the cabinets, effecting speed and volume handling, and each cabinet arrangement must serve approximately 450 students in about 15 minutes without reloading, the system arrangement shown herein having this capacity. Thus, capacity requirements can be predicted with accuracy according to the daily attendance and number of serving periods. The system is completely mobile so as to be set up and/or dismantled or stored with minimum effort, and requires no plumbing or venting, etc. The only requirement is the input of electrical power, and that is minimized by the combined convection, absorption, and recirculation of air with minimum heat induction. Pilfering and contamination is prevented by systemized covers and sneeze guards that are secured in operative position by common lock bar anchors, and all of which ensures profitable food distribution under sanitary conditions. The Refrigerated Cold Cabinet R includes all of these features.

It is an object of this invention to provide rapid serving of foods in three general categories; namely, refrigerated, frozen and hot pre-packaged foods. The service lines for this purpose must be adapted to varied situations and circumstances, and varied in configuration according to demand as related to the ratio and quantities of the aforementioned categories of foods to be served. For example on warm and/or hot days an abundance of cold foods is preferred, in which case the service lines are augmented by additional Refrigerated Cold Cabinets, each of which is self-sufficient as are the cooperatively arranged hot cabinets H, frozen cabinets F and merchandizing cabinets M. With the present invention, these cooperative cabinets are of identical height and width configuration and are all "bin type" cabinets adapted to carry trays of prepackaged foods. Practicality of this system resides in the mobility of the individual cabinets which are on casters or wheeled supports, whereby the service line can be quickly erected, modified or broken down for storage, and all the while each unit or cabinet can remain plugged into a power outlet and in operation.

The bin type Refrigerated Cold Cabinet R of the present invention is essentially a vessel through which refrigerated air is circulated by convection to maintain pre-packaged foods at serving temperature and/or to bring them to a serving temperature. As is well known, cold air tends to sink in warmer air, especially within the confines of the corners of such cabinets, and it is to this end that I have discovered means to efficiently operate such bin type cabinets substantially without the induction of heat from the surrounding atmosphere, by the combined utilization of convection, and re-circulation principles applied to optimum advantage. With the present invention, a food well is completely surrounded by a plenum distributing refrigerated air that is continuously recirculated by a blower means drawing from corner to corner at the front wall of the well and delivering said air through refrigeration means and into a plenum that distributes refrigerated air to the far corners of the well at the back wall thereof for discharge into said well.

It is an object of this invention to provide a Refrigerated Cold Cabinet having the features thus far described and so combined with a condenser unit, that servicing is facilitated while efficient operation with continued recirculation of refrigerated air is maintained. With the present invention, the well bottom is spaced above the supporting floor level and the space beneath the well divided into front and rear chambers, the former for the cooperative reception of a complete refrigeration unit and the latter comprising the refrigeration air distribution plenum. As will be disclosed, the refrigeration unit is a replaceable module that inserts through an insulated bulkhead that separates the two chambers, the refrigerated well being insulated in its entirety and surrounded by recirculated and convection flow of refrigerated air.

SUMMARY OF THE INVENTION

The Refrigerated Cold Cabinet R herein disclosed is a bin type cold box that operates on the principles of convection, absorption and recirculation, all of which is implemented by combined means advantageously utilizing said principles. Generally, the Refrigerated Cold Cabinet R involves a three dimensional rectangular body B within which there is a depending well W in spaced relation thereto establishing a recirculation plenum P at the rear and between the corners of the well for the continuous discharge of refrigerated air, there being induction means A at the front and between the corners of the well circulating convection air through blower means C and through refrigeration means D for discharge into the plenum for subsequent recirculation. The structure is sheet metal with reinforcements as required, is completely self-contained and preferably electrically powered. The Refrigerated Cold Cabinet R is of countertop height with the well bottom spaced substantially above the floor level, with the refrigeration means D and related blower means C housed as a refrigeration unit X within concealing lower aprons of the front of the body B.

DRAWINGS

The various objects and features of this invention will be fully understood from the following detailed description of the typical preferred form and application thereof, throughout which description reference is made to the accompanying drawings, in which:

FIG. 5 is a plan view of the refrigeration unit as it appears removed from the cabinet.

FIG. 6 is an end view of the Refrigerated Cold Cabinet showing a super-structure replacing the lock bar, and FIG. 7 is an enlarged detailed sectional view taken as indicated by line 7—7 on FIG. 6.

PREFERRED EMBODIMENT

Figure 1:
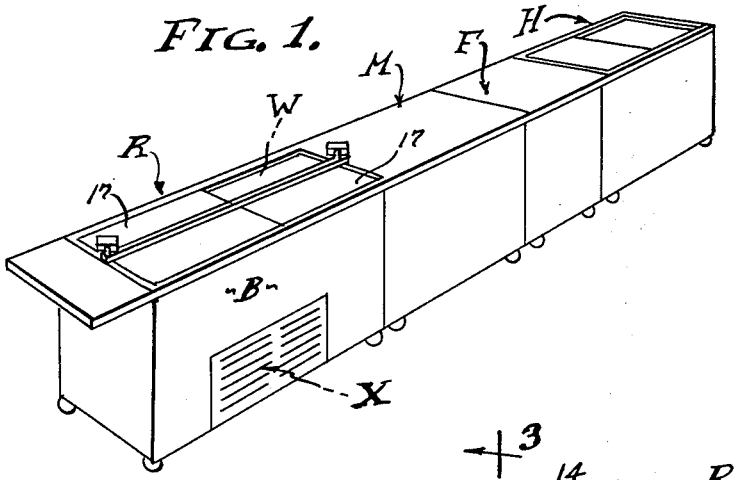
FIG. 1 is a perspective view of the feeding system which involves the Refrigerated Cold Cabinet.
Figure 2:
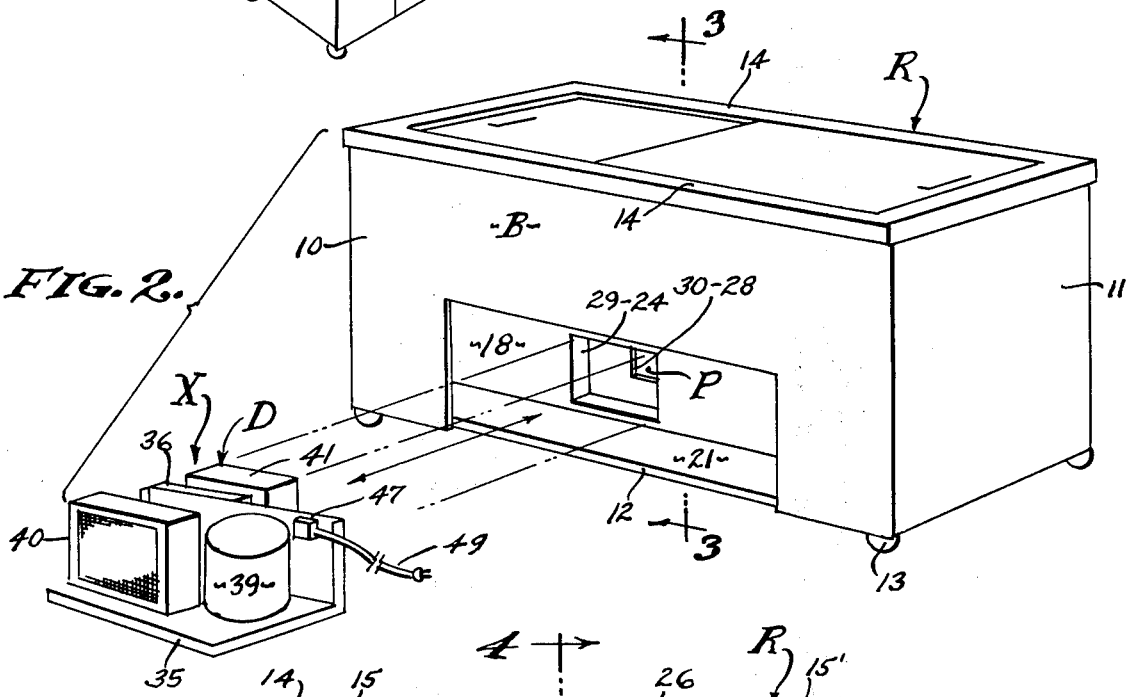
FIG. 2 is an exploded perspective view illustrating the replacability of the refrigeration unit therein.
Figure 3:
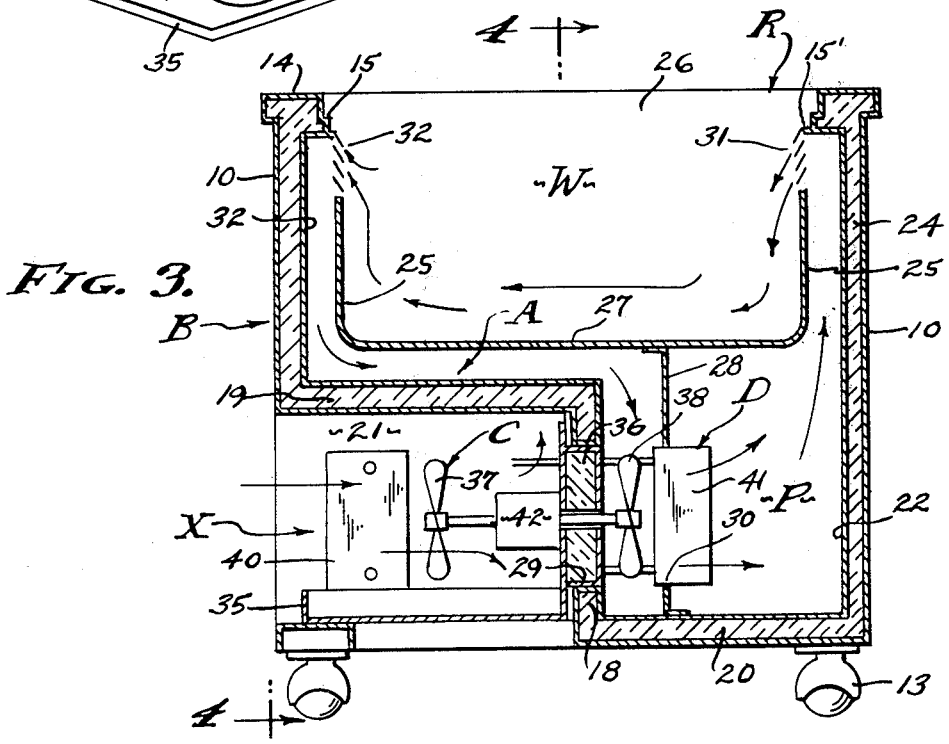
FIG. 3 is a transverse section taken as indicated by line 3—3 on FIG. 2.
Figure 4:
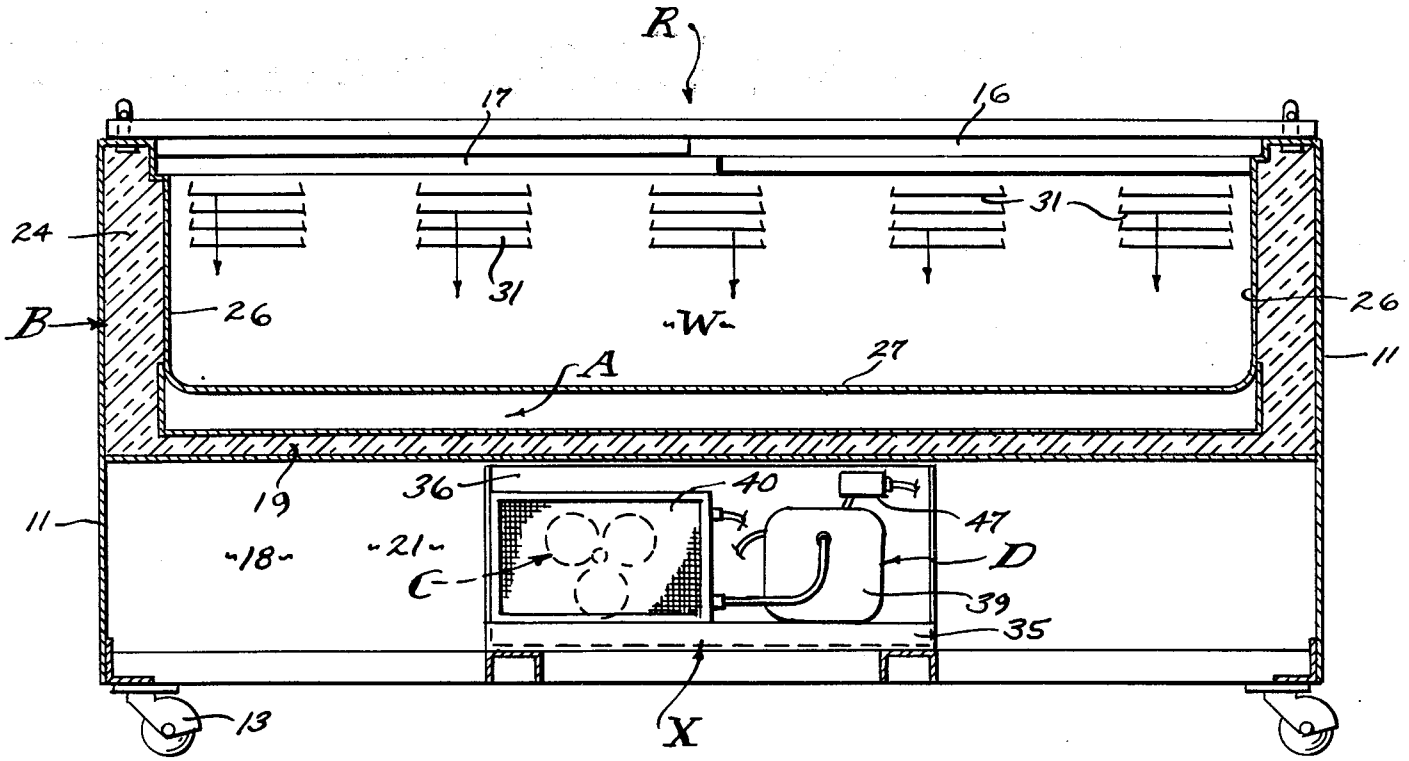
FIG. 4 is a longitudinal sectional view taken as indicated by line 4—4 on FIG. 3.

Referring now to the drawings, the body B is an elongated rectangular housing of substantial size; nominally 34 inches high (from the floor), 30 inches in width, and 62 inches in length. In practice, the body is a sheet metal structure having flat and parallel side and end panels 10 and 11 that are vertically disposed; the lower edges of which are reinforced by a frame 12 supported at its four corners by wheeled casters 13 or the like. The upper edges of the panel 10 and 11 are capped by a rail 14 having double steps 15 and 15' adapted to support upper and lower covers 16 and 17 that are slideable thereon and/or removeable therefrom. Each cover 16 and 17 is a sheet metal envelope with spaced planar top and bottom faces containing insulation therebetween, and adapted to overlap at the center of the cabinet when engaged with opposite ends thereof respectively.

In accordance with this invention, the bottom of the cabinet is stepped and divided into front and rear chambers for the reception of a refrigeration unit X and its exposure into the recirculation plenum P. As shown, there is a vertically disposed bulkhead 18 extending coextensively between the end panels 11 and spaced parallel to the side panels 10, the front portion 19 of the bottom being stepped up at the front of the cabinet and the rear portion 20 of the bottom being stepped down at the rear of the cabinet. In other words, the cabinet is characterized by vertically spaced bottom portions establishing an equipment chamber 21 and a recirculation plenum P with the bulkhead 18 therebetween. The bottom, as well as the cabinet sides and ends, comprised of the bulkhead 18 and front and rear portions 19 and 20 are insulated so as to prevent heat transfer or induction into the interior, and to this end a liner 22 is provided in spaced relation and complementary to the sides and ends and bottom with insulation 24 between said liner and the outside walls.

In accordance with this invention, the well W is disposed to depend within the above described insulated body B in spaced relation to the insulated walls thereof, so as to establish the induction means A and the recirculation plenum P. The well is comprised of sides and ends 25 and 26, and with a bottom 27 disposed in spaced parallel relation to the sides and ends and the bottom walls of the cabinet respectively. A baffle 28 separates the induction means A from the plenum P and is comprised of a vertically disposed wall spaced from bulkhead 18 and extending between the bottom portion 20 of the cabinet and bottom 27 of the well and between the inner faces of the opposite end panels 11 of the cabinet, thereby isolating the chamber 21 and the plenum P. In carrying out this invention, the sides and ends of the well are integral depending continuations of the rails 14, with rounded corners or fillets joining the same integrally with the bottom 27 thereof. Thus, the plenum P is coextensive with both the bin formation of the body B and with the complementary bin formation of the well W. In practice the well W is spaced inwardly approximately 3 inches from the liner 22.

Referring now to the replacability of the refrigeration unit X, there are aligned openings 29 and 30 through the bulkhead 18 and baffle 28, respectively, and which includes openings through the outer wall, the liner and the insulation of said bulkhead. In practice, the openings 29 and 30 are rectangular and sized such as to freely pass the evaporator of the refrigeration unit X, so that the evaporator enters into the plenum P while the remaining equipment of the unit X occupies the equipment chamber 21. As shown, the aligned openings 29 and 30 are centered in the bulkhead and baffle, the space between the bulkhead and baffle and opening through the baffle being in open communication with the induction means next to be described.

A feature of this invention is the recirculation of refrigerated air into the well W and its contents, distributed by louvers 31 and 32 disposed coextensively with the length of well W. As will be described, refrigerated air is charged into the plenum P by the blower means C, filling the plenum with a dynamic column of air at a temperature somewhat lower than the temperature to be established within the well. It will be observed that the sides 25, ends 26 and bottom 27 of the well are imperforate sheet metal members that have coextensive interface contact with the moving column air therewithin and also within the induction means A and within the plenum P, all within the confines of the insulated cabinet body B.

In accordance with this invention, the refrigerated air is dynamic and maintained as a moving column discharged into the well W and thereafter retrieved by the induction means A. The said dynamic column of air flows into the plenum P through opening 30 where it spreads out to rise between the rear walls 10 and wall 25, the space therebetween being in open communication with the plenum P. Discharge of the refrigerated air is from louvers 31 immediately below the rails 14. In practice, the refrigerated air is directed or nozzled downwardly and inwardly into the well W as by means of downwardly turned vanes of the louvers 31 extending coextensively from end to end of the well. Consequently, the discharged refrigerated air is connected downwardly into the well W and its contents to condition the same.

Another feature of this invention is the induction means A which directs the refrigerated air as a dynamically moving column into the blower means C. A phenomenon of the three dimensional rectangular well W, is the convection current fall of colder air and the convection rise of warmer air as it moves transversely and at the corners thereof where the sides 25 and ends 26 adjoin. In practice, at the front of the well louvers 32 comprise downwardly turned vanes that inversely draw air upwardly and inwardly into the space between the front wall 10 and 25 to be in open communication with the blower means C of the refrigeration unit next to be described.

In accordance with this invention, the refrigeration unit X comprised of the blower means C and refrigeration means D is replaceable and cooperatively received in the equipment chamber 21 and arranged with fans for the independent flow of condenser air and refrigerated air, and with a heat absorption evaporator inserted through the bulkhead 18 for exposure in the dynamic air column. Accordingly, the unit X involves the integration of blower means C and refrigeration means D, combined on a chasis 35 that carries a closure 36 for the bulkhead opening 29, carries the blower means C with a fan 37 exposed in the equipment chamber 21 and with a fan 38 exposed in the plenum P, that carries the refrigeration compressor 39 and condenser 40 in the equipment chamber 21, and that carries the evaporator 41 thereof in the plenum P. As shown, the blower means C is comprised of a motor 42 having a shaft 43, one end of which driveably carries the fan 37 adjacent the condenser 40 and the other end of which driveably carries the fan 38 adjacent the evaporator 41. The closure 36 is a plug having an outer wall 44 with a perimeter seal 45 engageable with the bulkhead 18 and a liner with insulation, and all of which forms a continuation of the bulkhead; and the blower shaft 43 projects through a close opening in the closure 36 so that the two fans operate in separate chambers. In practice, the blower shaft 43 terminates short of the baffle 28 while the evaporator 41 occupies and/or extends through the opening 30 in the baffle 28. Thus, two separate columns of air are continuously circulated by the blower means C, cooling air drawn through the condenser 40 by the fan 37 and refrigeration air drawn through the evaporator 41 by the fan 38.

The refrigeration means D has a motor driven compressor 39 that circulates compressed refrigerant through a condenser 40 and thence through a capillary tube 46 for expansion into the evaporator 41. The chassis 35 comprises a tray that underlies the refrigeration components, all within the equipment chamber 41, and the hot line of the compressor dips into the tray in order to evaporate away condensation collected therein. Further, the thermostat 47 is on the unit and mounted upon the closure 36 with the temperature responsive element 48 thereof extended through the closure and carried by the evaporator 41 for exposure within the plenum P.

From the foregoing, it will be seen that the combined blower means C and refrigeration means D provides a self-contained refrigeration unit X that is replaceably installed in the equipment chamber 21 with the evaporator 41 and thermostat controls 47 exposed within the plenum P. The only service connection is the electrical power cord 49 and to the end that removeability and installability is greatly simplified. In practice therefore, it is most economical to replace a faulty refrigeration unit X rather than to service the same within the cabinet B, thereby maintaining full time operation of the Cold Cabinet Server and relegating repairs to the refrigeration shop and/or manufacturing technicians. Consequently, food service line shutdowns are eliminated by making the refrigeration units X readily available on short notice, and all of which is accomplished in a most sanitary manner without food contamination from the problems which might and often do arise out of partial or complete mechanical failures.

Having described only a typical preferred form and application of my invention, I do not wish to be limited or restricted to the specific details herein set forth, but wish to reserve to myself any modifications or variations that may appear to those skilled in the art.

I claim:

1. A Cold Cabinet for conditioning prepackaged foods and the like to maintain refrigeration of the same and including; a bin type cabinet with insulated side and end and bottom panels, the bottom panel being stepped with a bulkhead disposed between the end panels dividing the cabinet into an equipment chamber exterior thereto and a recirculation chamber interior thereto and there being an opening through the bulkhead, a baffle within the cabinet and disposed between the end panels in spaced relation to the bulkhead and there being an opening through the baffle, said openings in the bulkhead and baffle being aligned, an upwardly open well complementary to and depending into the cabinet with side and end and bottom walls in spaced relation to the aforementioned body panels respectively, the bottom wall of the well being engaged with and carrying the baffle dividing the space between the cabinet panels and well walls into an air intake means vented from the well and an air recirculating means vented into the well, and a replaceable refrigeration unit comprised of closure means disengageable in the bulkhead opening and an evaporator disengageable in the baffle opening and a blower means having a motor shaft with an exterior refrigeration cooling fan in said equipment chamber and extending into said recirculation chamber with an interior recirculating fan for moving air from the intake means and through the evaporator and into the recirculating means.

2. The Cold Cabinet as set forth in claim 1, wherein the blower means has a motor within the equipment chamber and a shaft extending through the closure and to drive the interior recirculating fan for moving air from the intake means and through the evaporator.

3. The Cold Cabinet as set forth in claim 1, wherein the refrigeration unit has a chassis carried together with the said closure and supporting a compressor and a condenser exteriorly and cooled by the blower means with its shaft extending through the closure and to the interior recirculating fan for moving air from the intake means through the evaporator.

4. The Cold Cabinet as set forth in claim 1, wherein a thermostat control of said refrigeration unit extends through said closure and is exposed to the refrigerated air within the said recirculation plenum.

5. The Cold Cabinet as set forth in claim 1, wherein a thermostat control of said refrigeration unit extends through said closure for exposure to the refrigerated air within the said recirculation plenum, wherein the refrigeration unit has a chassis carried together with the said closure and supporting a compressor and a condenser exteriorly and cooled by the blower means with its shaft extending through the closure and to the interior recirculating fan for moving air from the intake means through the evaporator.

* * * * *